United States Patent [19]

Righi

[11] Patent Number: 4,766,718

[45] Date of Patent: Aug. 30, 1988

[54] POSITIONING MECHANISM FOR A TRAVELING AUTOMATIC MAINTENANCE UNIT FOR A TEXTILE RING SPINNING MACHINE OR THE LIKE

[75] Inventor: Ivo Righi, Esslingen, Fed. Rep. of Germany

[73] Assignee: Zinser Textilmaschinen GmbH, Fed. Rep. of Germany

[21] Appl. No.: 919,219

[22] Filed: Oct. 15, 1986

[30] Foreign Application Priority Data

Oct. 16, 1985 [DE] Fed. Rep. of Germany ..... 3536850

[51] Int. Cl.[4] ..... D01H 15/00; D01H 9/00; D01H 9/10

[52] U.S. Cl. ..... 57/1 R; 57/261; 57/262; 57/268; 57/276

[58] Field of Search ..... 57/1 R, 276, 277, 261–263, 57/274, 278, 268

[56] References Cited

U.S. PATENT DOCUMENTS

| | | | |
|---|---|---|---|
| 3,651,628 | 3/1972 | Harmon et al. | 57/1 R |
| 3,656,289 | 4/1972 | Merck | 57/261 |
| 3,673,780 | 7/1972 | Merck | 57/261 |
| 3,728,852 | 4/1973 | Anderson et al. | 57/261 |
| 3,827,226 | 8/1974 | Lessen | 57/261 |
| 4,102,115 | 7/1978 | Hemala et al. | 57/261 |
| 4,606,186 | 8/1986 | Stahlecker | 57/263 X |
| 4,611,463 | 9/1986 | Smith et al. | 57/263 |
| 4,628,684 | 12/1986 | Morita et al. | 57/263 |
| 4,644,742 | 2/1987 | Lovas et al. | 57/263 |

FOREIGN PATENT DOCUMENTS

| | | |
|---|---|---|
| 2117585 | 11/1971 | Fed. Rep. of Germany . |
| 1760259 | 4/1972 | Fed. Rep. of Germany . |
| 2163140 | 12/1972 | Fed. Rep. of Germany . |
| 2711163 | 9/1978 | Fed. Rep. of Germany . |
| 3321058 | 12/1983 | Fed. Rep. of Germany . |
| 1507089 | 4/1978 | United Kingdom . |

*Primary Examiner*—John Petrakes
*Attorney, Agent, or Firm*—Shefte, Pinckney & Sawyer

[57] ABSTRACT

A positioning mechanism for a traveling automatic maintenance unit for a textile ring spinning machine or the like, which unit includes a carriage movable on spaced tracks along the spinning stations of the machine for automatically stopping at spinning stations that are determined to require maintenance. The mechanism includes a frame that is transversely pivotally mounted on the carriage on a longitudinally extending shaft. The frame carries an automatically operable maintenance mechanism that pivots with the frame transversely into operating position at a spinning station. Transverse movement of the frame is accomplished by a pneumatic piston-cylinder mechanism that manipulates a sliding element on a transversely extending rod of a slide guide with the frame connected to the sliding element by a connecting linkage. An aligning device in the form of a bifurcated member is also movable with the sliding element to move into straddling engagement with the vertically depending spindle bearing of the spinning station to guide the carriage, frame and maintenance unit into proper alignment. The bifurcated member has an aligning slot with an opening wider than the engaging extent of the spindle bearing for initial engagement therewith and tapering to an aligning width at which the slot extends with generally parallel inner walls to maintain the maintenance unit in proper alignment during movement into operating position. The aligning slot has an inner end that serves as a stop for maintaining the maintenance unit in operating position, and a latched element releasably engages the spindle bearing and maintains the inner end of the aligning slot against the spindle bearing to maintain the maintenance unit in proper operating position.

14 Claims, 1 Drawing Sheet

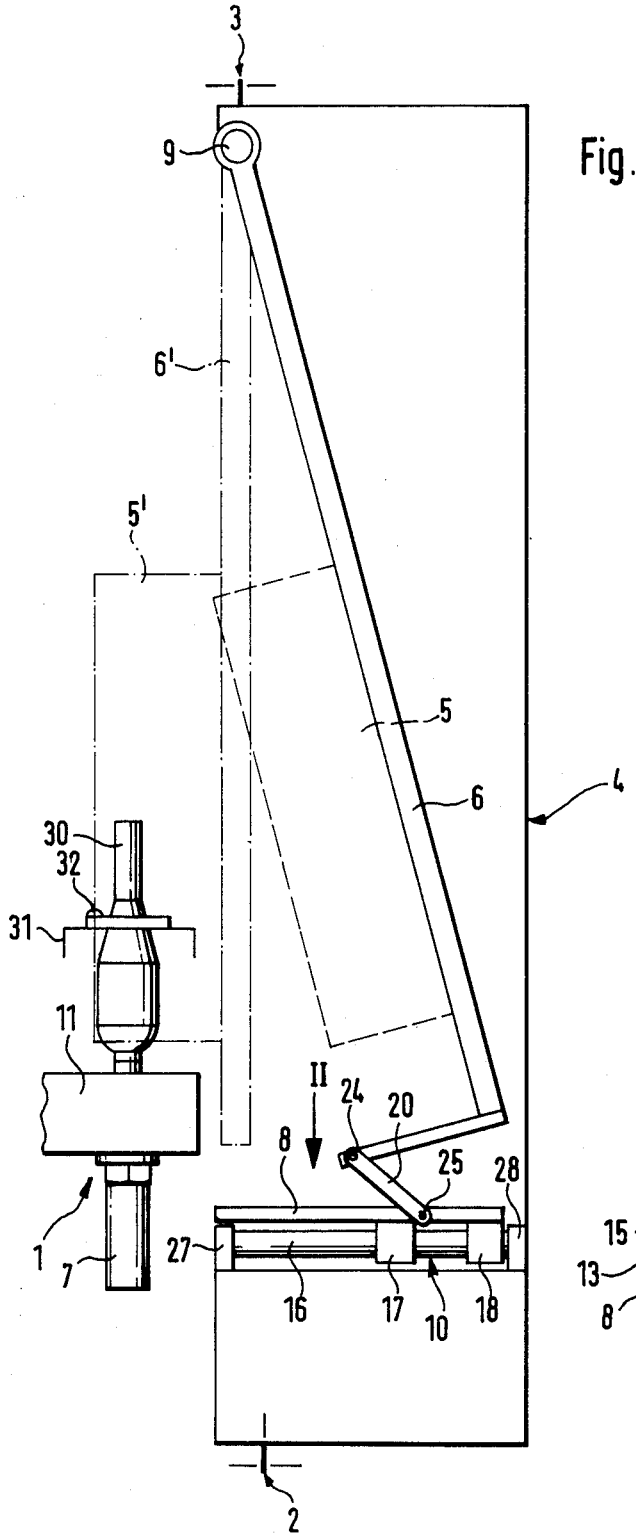
Fig. 1
Fig. 2
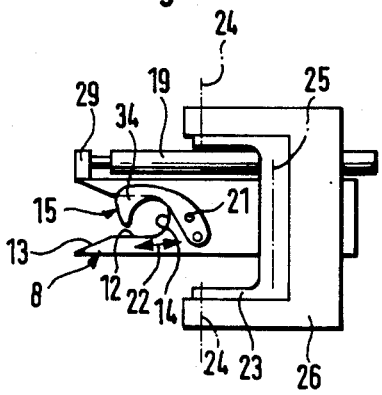

POSITIONING MECHANISM FOR A TRAVELING AUTOMATIC MAINTENANCE UNIT FOR A TEXTILE RING SPINNING MACHINE OR THE LIKE

BACKGROUND OF THE INVENTION

The present invention relates to a positioning mechanism for a traveling automatic maintenance unit for a textile ring spinning machine or the like, and more particularly to such a positioning mechanism that moves along the spinning stations of a ring spinning machine and automatically stops at spinning stations that are determined to require maintenance to be performed by the unit.

A traveling automatic maintenance unit of this type requires provision for movement of the unit along the spinning stations without interference and lateral movement into operating position when the unit is at a spinning station at which the maintenance function is to be performed. Because the maintenance unit must interrelate with the components of the spinning station in performing the maintenance operation, it is necessary that the maintenance unit move into precise alignment with the spinning station components as it pivots into operating position.

SUMMARY OF THE INVENTION

By the present invention, a positioning mechanism is provided that functions to accomplish transverse pivoting movement of the maintenance unit from a position at which it can move along the spinning stations without interference into an operating position at a spinning station at which a maintenance operation is to be performed, and in moving into operation position the unit is automatically aligned moves into operating position and is maintained in proper alignment by the positioning mechanism during performance of the maintenance function by the maintenance unit.

Briefly described, the positioning mechanism of the present invention is used with a traveling automatic maintenance unit for a textile ring spinning machine or the like where the spinning machine has a plurality of adjacent spinning stations and the traveling unit includes a carriage movable on a track along the spinning stations for stopping to perform a maintenance operation at a spinning station that is determined to require maintenance. The positioning mechanism includes a frame for carrying the automatically operable maintenance unit and is movable transversely of the track into the operating position adjacent the spindle at which the maintenance operation is to be performed. An aligning device is provided for engagement with a component of the spinning station during transverse movement of the frame into operating position to properly align the frame with the spinning station for effective operation thereat.

In the preferred embodiment of the present invention, the frame is pivotally mounted on a shaft mounted on the carriage longitudinally of the track for pivoting of the frame and maintenance unit from a position out of interference with the spinning stations during movement of the carriage along the spinning stations into an operating position at a spinning station. The frame is guided in its pivoting movement by a slide guide in the form of a rod mounted on the carriage and extending transversely and generally linearly. A sliding element is slidably carried on the slide guide and connects to the frame by a connecting linkage that accommodates pivotal movement of the frame with linear sliding movement engagement on the guide. A pneumatic piston-cylinder mechanism operates the sliding element to effect pivoting movement of the frame into and out of operation position. The aligning device of the preferred embodiment is in the form of a bifurcated member mounted on the carriage for straddling engagement with a component of the spinning station, such as the vertically depending spindle bearing. This bifurcated member has an aligning slot with an opening wider than the engaging extent of the spindle bearing to provide tolerance in initial engagement. The slot tapers to an aligning width where the inner walls extend generally parallel for positioning the maintenance unit properly during movement into operating position. The inner end of the aligning slot serves as a stop for engaging the spindle bearing and maintaining the maintenance unit in operating position. A latch element is mounted on the bifurcated member for engagement with the spindle bearing when the spindle bearing is against the stop for releasably maintaining the inner stop end of the slot against the spindle bearing and therefore, maintaining the maintenance unit in proper operating position. By the use of the piston-cylinder mechanism the positioning mechanism of the present invention is capable of moving the maintenance unit into proper position by abutment of the inner end of the slot against the spindle bearing at all spinning stations regardless of variations in the spacing of the track from the individual spindle bearings.

By the present invention, a simple construction and operation is obtained in a reliable manner to effect proper and efficient maintenance of the operation of the spinning machine, thereby reducing down time to a minimum. Further, the pivoted arrangement of the frame and the shape of the aligning slot provide for movement of the maintenance unit along the spinning stations without interference while providing for precise alignment when the maintenance unit is moved to operating position and importantly the slot provides for alignment of the maintenance unit as it approaches the spindle bearing so that it does not interfere with the spindle bearing or other spinning components as it moves into operating position.

Other features and advantages of the present invention will be apparent from the following description of the preferred embodiment and from the accompanying drawings.

BRIEF DESCRIPTION OF THE DRAWINGS

FIG. 1 is a side elevation of a portion of a spinning station of a ring spinning machine with a carriage located thereat carrying a maintenance unit and a positioning mechanism of the preferred embodiment of the present invention, with the positioning mechanism positioning a maintenance unit shown in dash lines in a position out of its operating position and illustrating the frame of the positioning mechanism and the maintenance unit in dash-dot lines in the operating position; and FIG. 2 is a plan view of the lower portion of the positioning mechanism included in FIG. 1 as viewed from the arrow designated II in FIG. 1.

DETAILED DESCRIPTION OF THE PREFERRED EMBODIMENT

Referring to FIG. 1, a part of a spinning station 1 of a ring spinning machine is illustrated. Such ring spinning machine usually consists of a plurality of spinning positions 1, commonly referred to as spindles, which are arranged in a row adjacent each other preferably on both sides of the machine, with as many as up to approximately 1000 spindles on a typical machine. The spinning station 1 includes a spindle bearing plate 11 in which a spindle 30 is carried in a vertically depending spindle bearing 7. A ring rail 31 with a traveler 32 is located above the spindle bearing plate 11. Associated with each spinning position 1 above the ring spindle 30 in a known manner is a conventional drafting device (not shown) from which the roving yarn being spun is applied to the spindle 30.

The ring spinning machine is provided with a traveling carriage 4 that moves preferably in a U-shaped track about the ring spinning machine and carries an automatic maintenance unit 5 that monitors the individual spinning stations for yarn breaks and performs a yarn piecing operation in a known manner. The carriage 4 is guided along the front of the ring spinning machine on a lower horizontal track 2 which includes a conventional rail and is indicated schematically in FIG. 1. Another guide for the carriage 4 is provided above the spinning machine in a conventional form of a horizontal track 3 with appropriate rollers, as indicated schematically in FIG. 1.

The traveling carriage 4 is provided in the location of the lower track 2 with an undercarriage that contains an electronic control that is not illustrated in detail as it forms no part of this invention. This electronic control is provided with a detector circuit which determines the presence of the yarn spun at the individual spinning stations. If a yarn break is determined, the traveling carriage 4 is stopped by the controls in a relatively precise positioning at the spinning station. However, the positioning provided by the control may result in deviations in the magnitude of approximately 10 mm from alignment with the spinning station 1.

The aligning of the traveling carriage 4 and of the components carried thereby is completed by the positioning mechanism of the present invention, for which purpose the traveling carriage 4 is free to move longitudinally on the tracks 2 and 3 in response to the aligning function of the positioning mechanism. To accomplish the precise positioning, the positioning mechanism includes an aligning device 8 that is movable transversely to the direction of travel of the carriage 4 and which aligns itself by straddling engagement of the spindle bearing 7. The aligning device 8 is in the form of a flat horizontal plate or member that is bifurcated to provide an aligning slot 12, 13 and 14 having its open end 13 facing the spindle bearing 7 for engagement thereof. The opening in the open end 13 of the slot is wider than the diameter or engaging width of the spindle bearing 7 to allow initial engagement thereof when there is a minor deviation in the initial positioning of the maintenance unit. The outer end 13 of the slot tapers inwardly to the approximate diameter or aligning width of the spindle bearing 7 with a slight tolerance. Thus, movement of the aligning member 8 into engagement with the spindle bearing 7 results in the tapered outer surface 13 of the slot forcing the member 8 and attached carriage components to move into alignment with the spindle bearing. The slot extends inwardly from the tapered opening 13 with generally parallel inner walls 12 at a spacing equivalent to the diameter of the spindle bearing 7 with a slight tolerance. These parallel walls maintain the aligning member 8 and carriage components, particularly the maintenance unit 5, in proper alignment during movement into operating position without interference with any of the spinning station components. The slot is also formed with an inner end 14 that serves as a stop for engagement against the spindle bearing 7 to position and maintain positioned the aligning member 8 and carriage components, including the maintenance unit 5, during performance of the maintenance operation.

Transverse movement of the aligning device 8 is accomplished by a conventional pneumatic piston-cylinder mechanism 19 that is mounted horizontally on the carriage 4 and has an end block 29 fixed to the side of the aligning device 8 for horizontal transverse movement of the aligning device 8 into engagement with the spindle bearing 7.

The aligning device is maintained in aligning engagement with the spindle bearing 7 against the inner end 13 of the slot by a latch element 15 in the form of a flat plate pivoted on the aligning device 8 on a vertical shaft 21 fixed to the aligning device 8 beyond the inner end 13 of the slot and having a hook-shaped portion 34 movable into latching engagement with the spindle bearing 7 when the inner stop end of the slot is against the spindle bearing 7. The hook-shaped portion 34 of the latch element 15 is shaped and located so that it is pivotally displaced by the spindle bearing 7 as it enters the slot to allow movement of the spindle bearing 7 fully into the slot. A conventional spring and pneumatic operator, indicated generally by the double arrow 22, connected to the aligning device 8 and latch element 15 functions to spring bias the latch element 15 in latching position after the spindle bearing is fully seated in the slot and to pivot the latch element 15 out of latching position to release the aligning member 8 from the spindle bearing 7 when the maintenance operation has been completed.

The automatic maintenance unit 5 mounted on the carriage 4 is illustrated schematically as it is not a part of the present invention. It includes devices for detecting and engaging broken yarn ends from the ring spindles 30 in order to piece the yarn ends to the roving yarn coming from the drafting device as well as for guiding the yarn back and placing it in the traveler 32. The maintenance unit 5 is located on a frame 6 that is movable transversely to the direction of the tracks 2 and 3 toward and away from the components of the spinning station 1, with the unit 5 partially laterally surrounding the ring spindle 30 in the operating position of the unit. In the retracted position of FIG. 1, the maintenance unit 5 is completely inside the extent of the carriage 4, so that it can pass by the spinning stations in an unimpeded manner.

The maintenance unit 5 is mounted on a frame 6, which is shown only schematically, that is suspended on a pivot shaft 9 that is attached above the level of the ring spindles 30 in the carriage 4 and is disposed in the longitudinal direction of the tracks 2 and 3. The pivot shaft 9 is disposed adjacent the side of the carriage 4 that faces the spinning stations 1. The lower end of the frame 6 is connected by a bracket 26 through a connecting linkage 20 to a slide guide spaced vertically below the shaft 9. This slide guide 10 includes a rod 16 that is mounted transversely on the carriage 4 in blocks 27,28 at the height of spindle bearings 7. Sliding elements 17,18 are slidingly mounted on the rod 16, and have the aligning device 8 mounted for movement therewith.

The aforementioned connecting linkage 20 is pivotally connected to the aligning device 8 by a shaft 25 extending longitudinally of the tracks 2 and 3 and has two arms 20 that extend to pivotal connection to the frame bracket 26 by a shaft 24 also extending longitudinally of the tracks 2,3. Thus, actuation of the operating piston-cylinder 19 to move the aligning device 8 into aligning position also causes pivoting of the frame 6 and maintenance unit 5 into operating position, with the connecting linkage 20 accommodating pivotal movement of the frame 6 and generally linear movement of the aligning device 8.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the eqivalents thereof.

I claim:

1. A positioning mechanism for a traveling automatic maintenance unit for a textile ring spinning machine or the like in which the spinning machine has a plurality of adjacent spinning stations and the traveling unit includes a carriage movable on a track along the spinning stations for stopping to perform maintenance at spinning stations that are determined to require maintenance, said positioning mechanism comprising a frame for carrying said automatic operable maintenance unit and movable together with said maintenance unit transversely of the track into operating position adjacent a spindle at the spinning station at which the maintenance operation is to be performed, and an aligning device movable into engagement with a component of said spinning station and being movable with transverse movement of said frame into operating position to cause said frame and said maintenance unit to properly align with said spinning station for effective operation thereat.

2. A positioning mechanism for a traveling automatic maintenance unit for a textile ring spinning machine or the like according to claim 1 and characterized further in that said aligning device is mounted on said carriage for alignment of said carriage, and said frame is mounted on said carriage for longitudinal movement therewith.

3. A positioning mechanism for a traveling automatic maintenance unit for a textile ring spinning machine or the like according to claim 1 and characterized further by a shaft mounted on said carriage longitudinally of the track, and in that said frame is mounted on said shaft for pivotal movement transversely of said track into operating position.

4. A positioning mechanism for a traveling automatic maintenance unit for a textile ring spinning machine or the like according to claim 3 and characterized further by a transversely extending slide guide mounted on said carriage at a spacing from said shaft in engagement with said frame for guiding transverse pivotal movement of said frame.

5. A positioning mechanism for a traveling automatic maintenance unit for a textile ring spinning machine or the like according to claim 4 and characterized further in that said slide guide extends generally linearly and engages said frame through a connecting linkage that accommodates pivotal movement of said frame with linear sliding movement engagement on said guide.

6. A positioning mechanism for a traveling automatic maintenance unit for a textile ring spinning machine or the like according to claim 4 and characterized further in that said slide guide comprises a rod transversely mounted on said carriage and in that said frame includes a sliding element slidably carried on said slide guide and connected to said frame.

7. A positioning mechanism for a traveling automatic maintenance unit for a textile ring spinning machine or the like according to claim 6 and characterized further in that said slide guide extends generally linearly and said sliding element is connected to said frame through a connecting linkage.

8. A positioning mechanism for a traveling automatic maintenance unit for a textile ring spinning machine or the like according to claim 1 and characterized further in that said aligning device comprises a bifurcated member mounted on said carriage for transverse movement into straddling engagement with a component of said spinning station.

9. A positioning mechanism for a traveling automatic maintenance unit for a textile ring spinning machine or the like according to claim 8 and characterized further in that said bifurcated member is straddingly engageable with a vertically depending spindle bearing at said spinning station.

10. A positioning mechanism for a traveling automatic maintenance unit for a textile ring spinning machine or the like according to claim 8 and characterized further in that said bifurcated member has an aligning slot formed therein for receiving said spinning station component, said slot being formed with an opening wider than the engaging extent of said spinning station component for initial engagement therewith and tapering to an aligning width for aligning the carriage and frame with the spinning station, said slot having generally parallel inner walls to maintain said carriage and frame in alignment during movement into operating position.

11. A positioning mechanism for a traveling automatic maintenance unit for a textile ring spinning machine or the like according to claim 10 and characterized further in that said slot is formed with an inner end that provides a stop for positioning said bifurcated member, carriage and frame transversely in operating position.

12. A positioning mechanism for a traveling automatic maintenance unit for a textile ring spinning machine or the like according to claim 11 and characterized further by a latch element operable to engage said spinning station component and releasably maintain the inner end of said slot against said component.

13. A positioning mechanism for a traveling automatic maintenance unit for a textile ring spinning machine or the like according to claim 11 and characterized further by pneumatic operating means for moving said bifurcated member on said carriage transversely thereof into operating position.

14. A positioning mechanism for a traveling automatic maintenance unit for a textile ring spinning machine or the like according to claim 8 and characterized further by a transversely extending slide guide mounted on said carriage and a sliding element slidably carried on said slide guide and connected to said frame, said bifurcated member being mounted for movement on said carriage with said sliding member.

* * * * *